US008506338B2

(12) United States Patent
Gallato et al.

(10) Patent No.: US 8,506,338 B2
(45) Date of Patent: Aug. 13, 2013

(54) CONNECTING PIECE THAT CAN BE INSERTED INTO A BOATS HULL

(75) Inventors: Fernando Gallato, Padua (IT); Adone Bertolo, Padua (IT); Andrea Tognon, Padua (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 164 days.

(21) Appl. No.: 13/145,607

(22) PCT Filed: Feb. 11, 2010

(86) PCT No.: PCT/EP2010/051699

§ 371 (c)(1), (2), (4) Date: Jul. 21, 2011

(87) PCT Pub. No.: WO2010/094613

PCT Pub. Date: Aug. 26, 2010

(65) Prior Publication Data

US 2011/0281480 A1 Nov. 17, 2011

(30) Foreign Application Priority Data

Feb. 18, 2009 (DE) ..... 10 2009 000 991

(51) Int. Cl.
*B63H 23/36* (2006.01)

(52) U.S. Cl.
USPC ..... 440/112

(58) Field of Classification Search
USPC ..... 440/111, 112
See application file for complete search history.

(56) References Cited

U.S. PATENT DOCUMENTS

| | | | | |
|---|---|---|---|---|
| 2,976,836 | A * | 3/1961 | Fageol | 440/112 |
| 3,812,607 | A * | 5/1974 | Fenske | 37/420 |
| 3,982,496 | A | 9/1976 | Blanchard | |
| 4,040,378 | A | 8/1977 | Blanchard | |
| 4,478,585 | A | 10/1984 | Brandt et al. | |
| 5,108,325 | A | 4/1992 | Livingston et al. | |
| 6,050,208 | A | 4/2000 | Kennedy | |
| 6,287,159 | B1 * | 9/2001 | Polakowski et al. | 440/52 |
| 6,503,601 | B1 * | 1/2003 | Edvardsen | 428/174 |
| 6,609,939 | B1 | 8/2003 | Towner et al. | |
| 7,186,157 | B2 | 3/2007 | Mansson et al. | |
| 7,387,556 | B1 | 6/2008 | Davis | |
| 8,011,983 | B1 * | 9/2011 | Davis et al. | 440/56 |

FOREIGN PATENT DOCUMENTS

| | | | |
|---|---|---|---|
| DE | 33 03 658 | A1 | 8/1983 |
| DE | 699 22 810 | T2 | 12/2005 |
| DE | 10 2008 048 219 | A1 | 5/2009 |
| WO | 2005/005249 | A1 | 1/2005 |

* cited by examiner

*Primary Examiner* — Stephen Avila
(74) *Attorney, Agent, or Firm* — Davis & Bujold, PLLC

(57) ABSTRACT

A connecting piece (1) that can be set or inserted into the hull of a boat. The connecting piece has an opening (2) therein for the passage of a pivoted boat drive unit. An outer edge area (3) of the connecting piece (1) facilitates fixing and sealing of the connecting piece (1) relative to the hull of the boat. The connecting piece (1) comprises a sandwich structure and the sandwich structure generally comprises an inner steel plate (5) and an outer steel plate (6) and an elastomer material arranged therebetween.

7 Claims, 2 Drawing Sheets

CONNECTING PIECE THAT CAN BE INSERTED INTO A BOATS HULL

This application is a National Stage completion of PCT/EP2010/051699 filed Feb. 11, 2010, which claims priority from German patent application serial no. 10 2009 000 991.4 filed Feb. 18, 2009.

FIELD OF THE INVENTION

The invention concerns a connecting that can be inserted into a boats hull, and a boat's hull.

BACKGROUND OF THE INVENTION

Known inboard boat drive systems comprise a steering and propulsion unit arranged under the water, which can pivot about a vertical axis. Propulsion is produced by one or more propellers, whose rotation axis can be pivoted by means of the steering unit. Pivoting of the propulsion vector results in a steering action for the boat. The propulsion and steering unit comprises a vertically arranged column which accommodates the driveshaft for the propellers and which passes through a bottom plate, also called the connecting piece, that is set into the hull of the boat. Especially in the case of motor yachts, the steering and propulsion unit determines the draft of the vessel and, when the vessel runs aground or a collision with underwater objects occurs, is therefore particularly exposed and at risk. It is known, when fixing the steering and propulsion unit to the hull, to provide predetermined breakpoints for example in the form of calibrated screw-bolts, so that if subjected to an impact of more than a defined severity the steering and propulsion unit will break away from the hull without the formation of a leak at the fracture points. A problem can arise, however, if after breaking away the steering and propulsion unit is flung backward, i.e. in the aft direction, and at the same time upward against the underside of the boat's hull. When struck by the sharp-edged propeller the hull can be damaged and a leak produced.

SUMMARY OF THE INVENTION

The purpose of the present invention is to provide better protection for the hull of the boat in the event of collision and at the same time to avoid impacts that result in leaks of the boat's hull.

According to the invention the connecting piece, through which the boat's drive system passes, has a sandwich structure, i.e. the connecting piece positioned at the bottom of the boat's hull is configured like a sandwich. The boat's drive system, i.e. its vertical column, passes through an opening in the connecting piece in such manner that no forces resulting from the thrust of the boat's drive unit are transmitted to the connecting piece. Instead, the boat's drive unit is connected by an elastic suspension arrangement directly to the hull of the boat, i.e. not via the connecting piece. The dimensions of the sandwich structure are such that if impact forces occur in the event of a crash the structure can be deformed so as to absorb deformation energy. This has the advantage that in the event of a crash the boat's hull is protected, since the impact forces that result from the crash are not transmitted directly to the hull, but are to the greatest possible extent dissipated by deformation work in the connecting piece. A further advantage is that during this deformation no leaks are produced, i.e. in a crash situation the safety of the boat is improved.

In a preferred embodiment the sandwich structure comprises an inner and outer (on the water side) steel plate, preferably made of stainless steel. In this way, on the one hand high strength and on the other hand sufficient deformability in the event of a crash are achieved.

In another preferred embodiment, at least one block of an elastomer material, in particular at least one rubber block, is arranged between the steel plates. This gives on the one hand a degree of rigidity in normal operation and on the other hand allows some yielding in the event of a crash.

According to a further preferred embodiment, the edge area of the connecting piece is sealed relative to the hull of the boat by a surrounding O-ring, an endless-loop seal. The O-ring is preferably set into a ring groove of a steel ring arranged between the hull and the inner steel plate. This provides a static sealing system between the edge area of the connecting piece and the hull of the boat. The advantage of the seal according to the invention is that it undergoes no movement-originated wear and therefore has long life and provides great safety. Moreover, the inner steel plate can be removed for maintenance purposes without damaging the O-ring.

In a further advantageous design the edge area of the connecting piece is connected to the boat's hull by screw-bolts, in such manner that the hull of the boat is clamped with a fixing flange between the two steel plates, and so sealed. This provides a safe and strong means for attaching the connecting piece onto the boat's hull.

In another advantageous design the outer steel plate on the water side is extended beyond the edge area in the aft direction to form an integral protective shield. This integration of the protective shield with the outer steel plate makes it unnecessary to fabricate and fit an additional protective shield.

According to the invention a boat's hull is provided with a connecting piece formed as explained above. The connecting piece, with its sandwich structure, is connected with its outer edge area firmly and intimately in contact against the hull of the boat, while the boat's drive system passes through the connecting piece "free from load", i.e. such that no reaction forces resulting from the propeller thrust are transmitted to the connecting piece. The connecting piece is designed as a crash component and thus protects the boat's hull, since it absorbs deformation energy in the event of a crash.

BRIEF DESCRIPTION OF THE DRAWINGS

An example embodiment of the invention is illustrated in the drawings and described in greater detail below, so that further features and/or advantages can emerge from the description and/or the drawings, which show.

DETAILED DESCRIPTION OF THE PREFERRED EMBODIMENTS

Figure 1A:
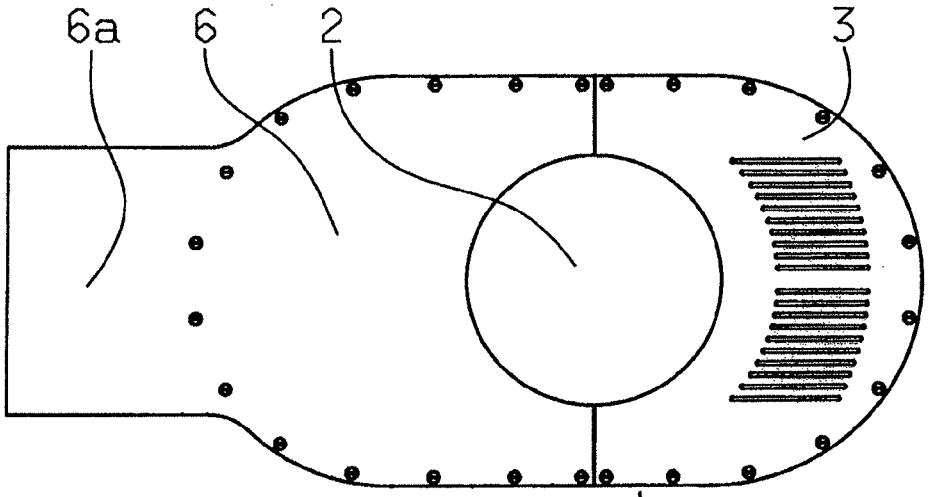
FIGS. 1*a* to 1*c*: A connecting piece according to the invention for a boat's drive system
Figure 1B:
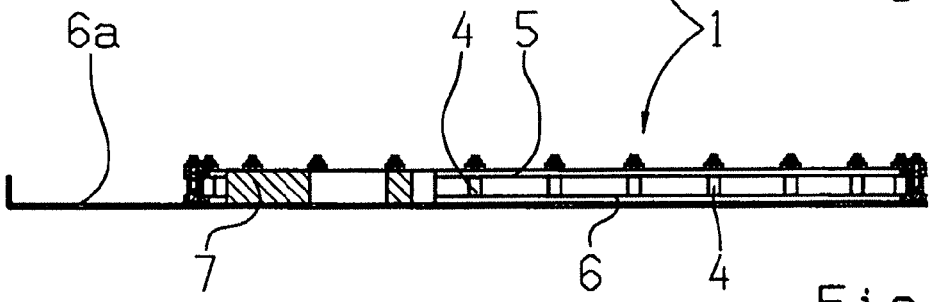
Figure 1C:
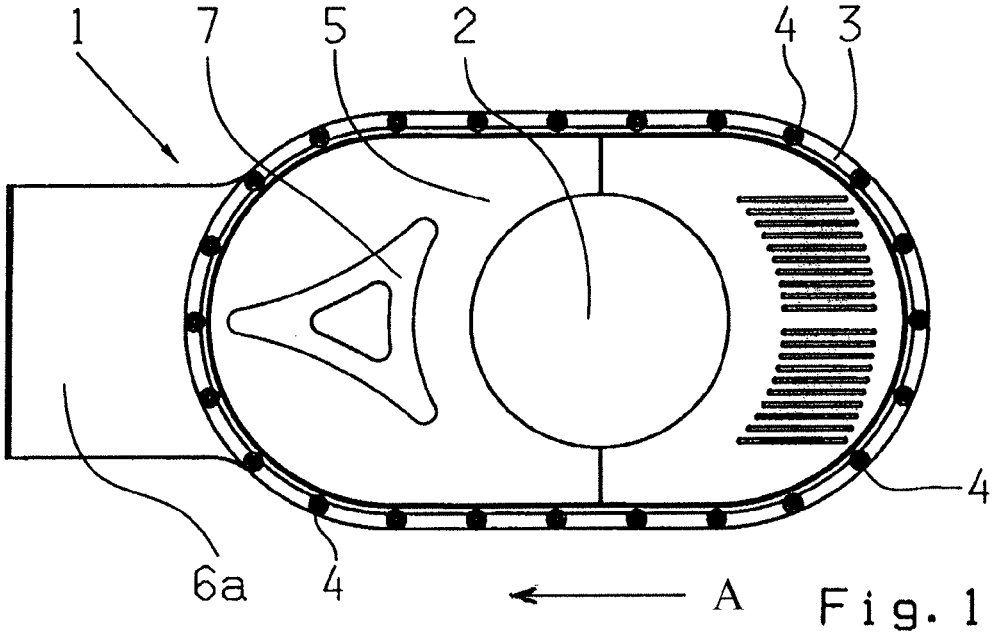

FIGS. 1*a*, 1*b* and 1*c* show, respectively, a view from below, a longitudinal section, and a view from above, of a connecting piece 1 used for mounting a drive unit (not shown) of a boat in a boat's hull (not shown). As mentioned at the beginning, such connecting pieces are known per se. The connecting piece 1 has a circular opening 2 through which passes a column (not shown) of the boat's drive unit that can pivot about a vertical axis. To the underwater end of the column is attached a propulsion unit (not shown), preferably a double propeller with coaxially arranged screws that rotate in opposite directions. The arrangement of the boat's drive unit is designed such that no forces resulting from the propeller thrust are transmitted to the connecting piece. Rather, the boat's drive unit is directly suspended relative to the hull by an elastic device, so that all thrust forces are transmitted as reaction forces directly into the hull. Thus, the connecting piece 1 can be made relatively light and as a so-termed crash component. Accordingly, it can absorb impact forces that occur during a crash by deformation of its structure, and in this way protect the hull from such forces. The connecting piece 1 has an oval-shaped edge area 3 in which are arranged a plurality of screw-bolts 4, which serve to fix it to the hull of the boat (not shown here). The connecting piece has a sandwich structure comprising an inner stainless steel plate 5, i.e. one that faces the inside of the boat, and an outer stainless steel plate 6 on the water side, these also being just called steel plates in what follows. Between the steel plates 5, 6 is arranged an approximately triangular block 7 of an elastomer material, preferably rubber. The outer steel plate 6 is extended in the aft direction, denoted by an arrow A, so as to form an integrated protective shield 6*a* made in one piece with the steel plate 6. The protective shield 6*a* guards the outer shell of the boat's hull against damage—particularly if in a collision the propulsion and steering unit breaks away and is flung against the boat's hull.

Figure 2:
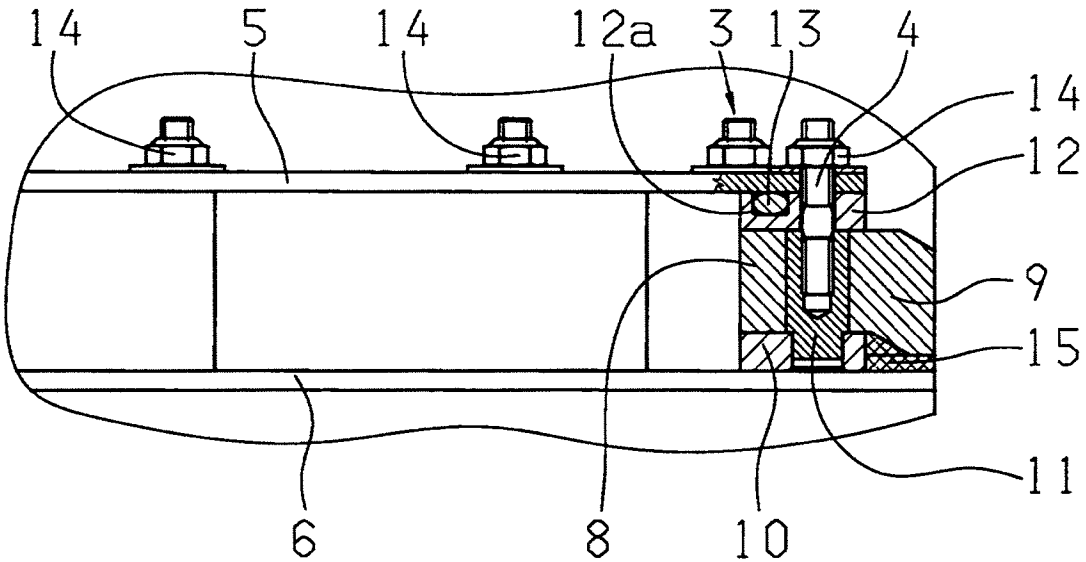
FIG. 2: The fixing of the connecting piece onto the hull of the boat.

FIG. 2 shows a junction of the edge area 3 with a fixing flange 8 of the hull 9. On the edge area 3 of the outer steel plate 6 is fixed a steel ring 10 to which a plurality of threaded bushes 11 distributed around the periphery are attached. The threaded bushes 11 pass through the fixing flange 8 and receive the screw-bolts 4. Between the inner steel plate 5 and the fixing flange 8 is arranged a steel ring 12 with a ring groove 12*a*, which holds an O-ring 13. By means of the O-ring 13, which is in intimate contact against the underside of the inner steel plate 5, the steel plate 5 is sealed with respect to the fixing flange 8. The fixing flange 8 of the boat's hull 9 is clamped between the two steel plates 5, 6 by means of the screw-bolts 4 and lock-nuts 14, with the threaded bushes 11 serving as spacers. The outer steel plate 6 on the water side is sealed relative to the hull 9 of the boat by a sealing and adhesive compound 15. The O-ring 13, in combination with the steel ring 12 and the inner steel plate 5, constitute a static sealing system, i.e. the seal is not subjected to wear caused by movement and can be put under a relatively large contact-pressure force so as to have a good sealing action.

For example for maintenance purposes, the inner steel plate 5 can be removed by undoing the lock-nuts 14, without damaging the O-ring seal 13.

INDEXES

1 Connecting piece
2 Opening
3 Edge area
4 Screw-bolts
5 Inner steel plate
6 Outer steel plate
6*a* Protective shield
7 Rubber block
8 Fixing flange
9 Hull of the boat
10 Outer steel ring
11 Threaded bush
12 Inner steel ring
12*a* Ring groove
13 O-ring
14 Lock-nut
15 Sealing compound

The invention claimed is:

1. A connecting piece (1) for insertion into a hull of a boat, the connecting piece (1) having an opening (2) for passage of a pivoted boat drive unit, the connecting piece (1) comprising an outer edge area (3) for fixing and sealing the connecting piece (1) relative to the hull (9) of the boat, the connecting piece (1) further comprising a sandwich structure, and the sandwich structure being deformable so as to absorb a collision force, the sandwich structure comprising an inner steel plate and an outer steel plate which are aligned across from each other with respect to the hull and are arranged such that the hull of the boat is sandwiched between the inner steel plate and the outer steel plate, and a sealing member being entirely arranged between the inner steel plate and the hull on a side of the hull opposite the outer steel plate, wherein the edge area (3) is sealed relative to the hull (9) of the boat by an O-ring (13), and the O-ring directly contacts the inner steel plate and is spaced from the hull.

2. The connecting piece according to claim 1, wherein at least a block (7) of an elastomer material is arranged between the inner and the outer steel plates (5, 6).

3. The connecting piece according to claim 1, wherein a steel ring is clamped directly between the inner steel plate and the hull, the steel ring has first and second opposite planar surfaces, the first planar surface of the steel ring mates with the inner steel plate and the second planar surface of the steel ring mates with the hull, the first planar surface of the comprises a ring groove and the O-ring (13) is arranged in the ring groove (12*a*) of the steel ring (12) that is clamped between the hull (9) of the boat and the inner steel plate (5).

4. The connecting piece according to claim 1, wherein the outer steel plate comprises a plurality of threaded bushes that are attached thereto, the threaded bushes pass through a fixing flange of the hull and receive screw bolts that pass through the inner steel plate such that the edge area (3) of the inner steel plate (5) and the outer steel plate (6) are connected, by the screw-bolts (4), to the fixing flange (8) of the hull (9) of the boat.

5. The connecting piece according to claim 1, wherein the outer steel plate (6) is extended aft beyond an oval outer edge area, to form an integrated protective shield (6*a*) for the hull of the boat.

6. A hull of a boat having a pivoted boat drive unit which passes through a connecting piece (1) which is fixed to the hull (9) of the boat, wherein the connecting piece (1) comprises an opening (2) for passage of the pivoted boat drive unit, the opening defines an axis which extends normal relative to the hull, an outer edge area (3) of the connecting piece (1) fixes and seals the connecting piece (1) relative to the hull (9) of the boat, the connecting piece (1) comprises a sandwich structure, and the sandwich structure is deformable so as to absorb a collision force, the sandwich structure comprises an inner steel plate and an outer steel plate which are axially aligned with each other on opposite sides of the hull such that the hull of the boat is sandwiched between the inner steel plate and the outer steel plate, a steel ring is sandwiched directly between the hull of the boat and one of the inner and the outer steel plates, a first surface of the steel ring mates with the one of the inner and the outer steel plates and comprises a ring groove, and an O-ring is received within the ring groove and contacts the one of the inner and the outer steel plates to form a seal between the one of the inner and the outer steel plates and the steel ring.

7. A connecting piece (1) for fixing and sealing a pivotable boat drive unit to a boat hull, the connecting piece (1) comprising:

inner and outer steel plates (5, 6);

an edge area (3) of the inner steel plate (5) being secured to an inner surface of the boat hull (9) and an edge area (3) of the outer steel plate (6) being secured to an outer surface of the boat hull (9) such that the inner and the outer steel plates (5, 6) sandwich the boat hull (9) therebetween;

the inner and the outer steel plates (5, 6) having an opening (2) extending therethrough and the pivoted boat drive unit passes through the opening (2);

the connecting piece (1) being deformable so as to absorb a collision force, and a plurality of connectors pass through one of the inner and the outer steel plates and are received within the boat hull to secure the one of the inner and the outer steel plates to the boat hull, wherein at least one elastomeric block (7) is located between the inner and the outer steel plates (5, 6), a first steel ring (12) is clamped between the inner surface of the boat hull (9) and the inner steel plate (5) and a surface of the first steel ring (12), which faces and directly contacts the inner steel plate, comprises a groove (12*a*) that receives an O-ring (13), the O-ring (13) forms a seal between the inner steel plate (5) and the inner surface of the boat hull (9), a second steel ring (10) contacts and is clamped between the outer surface of the boat hull (9) and the outer steel plate (6), the outer steel plate (6) comprises protective shield (6*a*) that extends in an aft direction (A) without the edge area (3) of the outer steel plate (6), and the second steel ring is fixed to the outer steel plate and a plurality of bushes are fixed to the second steel ring and extend through the boat hull, and the connectors are screw bolts that pass through the edge area of the inner steel plate and the first steel ring and threadably mate with the plurality of bushes to secure the connecting piece to the boat hull.

* * * * *